United States Patent [19]

Derfler

[11] Patent Number: 4,989,656

[45] Date of Patent: Feb. 5, 1991

[54] SELF-CLOSING SHOULDER BAG

[76] Inventor: Patricia A. Derfler, Rte. 1, Box 264, Nashwauk, Minn. 55769

[21] Appl. No.: 498,037

[22] Filed: Mar. 23, 1990

[51] Int. Cl.[5] ..... A45C 1/02; A45C 3/06; A45C 13/00; B65D 33/16

[52] U.S. Cl. ..... 150/108; 150/110; 150/118; 150/128; 150/900; 190/118; 383/43; 383/907

[58] Field of Search ..... 150/106, 107, 110, 111, 150/112, 118, 900, 101, 113; 383/43, 44; 190/118; 206/266; D3/42, 53

[56] References Cited

U.S. PATENT DOCUMENTS

| | | | |
|---|---|---|---|
| D. 113,486 | 2/1939 | Clark | 150/107 X |
| D. 140,228 | 2/1945 | Bertrand | D3/42 |
| D. 246,680 | 12/1977 | Sabol | D3/42 |
| D. 246,940 | 1/1978 | Sabol | D3/42 |
| D. 249,195 | 8/1978 | Winckler | D20/43 |
| D. 283,082 | 3/1986 | Hansen | D3/53 |
| D. 294,195 | 2/1988 | Starks | D3/42 |
| D. 299,384 | 1/1989 | Donnor | D3/53 |
| 325,807 | 9/1885 | Adams | 383/43 X |
| 833,101 | 10/1906 | Wighard | 150/107 |
| 1,527,830 | 2/1925 | Booker | 383/43 X |
| 1,815,106 | 7/1931 | Jostes | 150/107 |
| 2,284,212 | 5/1942 | Kanzow | 383/43 X |
| 2,916,071 | 12/1959 | Mirken | 150/110 X |
| 3,275,053 | 9/1966 | Kabana | 150/118 X |
| 3,422,868 | 1/1969 | Hannum | 150/112 X |
| 4,161,975 | 7/1979 | Stakofsky | 150/107 |

FOREIGN PATENT DOCUMENTS

| | | | |
|---|---|---|---|
| 1085387 | 2/1955 | France | 150/107 |
| 285648 | 1/1953 | Switzerland | 150/118 |
| 9181 | of 1911 | United Kingdom | 150/107 |

*Primary Examiner*—Sue A. Weaver

*Attorney, Agent, or Firm*—Christensen, O'Connor, Johnson & Kindness

[57] ABSTRACT

The present invention is a shoulder bag having a pouch made of flexible material that, once closed, will remain closed even if substantial weight is carried in the pouch. The construction of the pouch consists of joining together two substantially similar panels of flexible material to form a pouch with closed side and bottom edges and an open top edge. A shoulder strap is attached to the pouch near of the top of each said edge. If the panels of flexible material conform in size and shape to the present disclosure, the opening in the pouch will remain closed while the bag is in use.

16 Claims, 3 Drawing Sheets

SELF-CLOSING SHOULDER BAG

FIELD OF INVENTION

This invention relates to bags, pouches, and the like, and particularly to carryall shoulder bags.

BACKGROUND OF INVENTION

Shoulder bags and handbags have been made in a myriad of styles and designs. See, e.g., U.S. Pat. No. 783,190, issued to A. K. Gibson on Feb. 21, 1905; U.S. Pat. No. 833,101, issued to A. Wighard on Oct. 9, 1906; U.S. Pat. No. 1,815,106, issued to B. J. Jostes on July 21, 1931; U.S. Pat. No. 3,422,868, issued to M. K. Hannum on Jan. 21, 1969; U.S. Pat. No. 4,161,975, issued to C. Stakofsky on July 24, 1979; U.S. Pat. No. D113,486, issued to W. L. M. Clark on Feb. 28, 1939; U.S. Pat. No. D140,228, issued to E. H. Bertrand on Feb. 6, 1945; U.S. Pat. No. D246,680, issued to A. J. Sabol on Dec. 13, 1977; U.S. Pat. No. D249,195, issued to K. L. Starks on Feb. 16, 1980; and U.S. Pat. No. D299,384, issued to K. A. Donner on Jan. 17, 1989.

Frequently, such prior bags are supported by one or more relatively stiff components of the bag. Moreover, the opening in the bag is normally closed using the pressure or tension created by the stiffer component(s) of the bag, a flap covering the opening of the bag, or a mechanical closure such as a zipper or fastener at the opening of the bag.

Bags with two relatively straight side edges, a concavely curved top edge, and a convexly curved bottom edge are of the type known generally in the art. However, all such bags known to the applicant (a) do not appear to have the front panel and back panel attached directly to each other, (b) appear to have a mechanical closure such as a zipper for closing the opening, and (c) appear to be sized and configured primarily for aesthetic reasons.

It would be advantageous for certain uses to provide a shoulder bag, made entirely of flexible material, that does not require a mechanical closure or a flap to close the bag, and that will nevertheless stay closed while holding substantial weight.

SUMMARY OF THE INVENTION

The present invention is a shoulder bag having a pouch made of flexible material that, once closed, will remain closed even if substantial weight is carried in the pouch. The construction of the pouch consists of joining together two substantially similar panels of flexible material to form a pouch with closed side and bottom edges and an open top edge. A shoulder strap is attached to the pouch near the top of each side edge. If the panels of flexible material conform in size and shape to the present disclosure, the opening in the pouch will remain closed while the bag is in use.

DESCRIPTION OF PREFERRED EMBODIMENT

Figure 1:
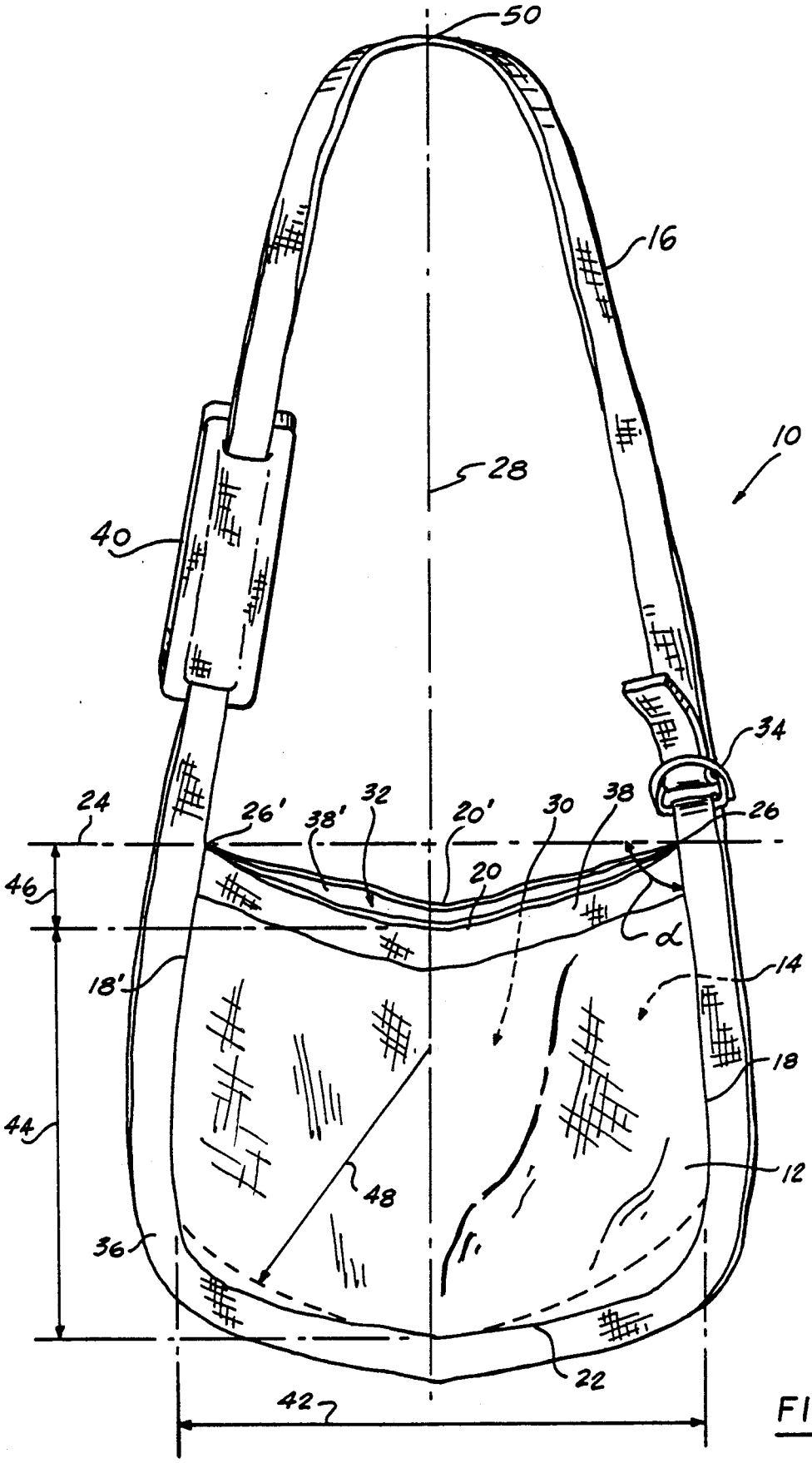
FIG. 1 is a perspective view of a representative self-closing shoulder bag constructed in accordance with the present invention.

Referring to FIG. 1, a self-closing shoulder bag 10 constructed in accordance with the invention has a front panel 12, a back panel 14, and a strap 16.

Figure 2:
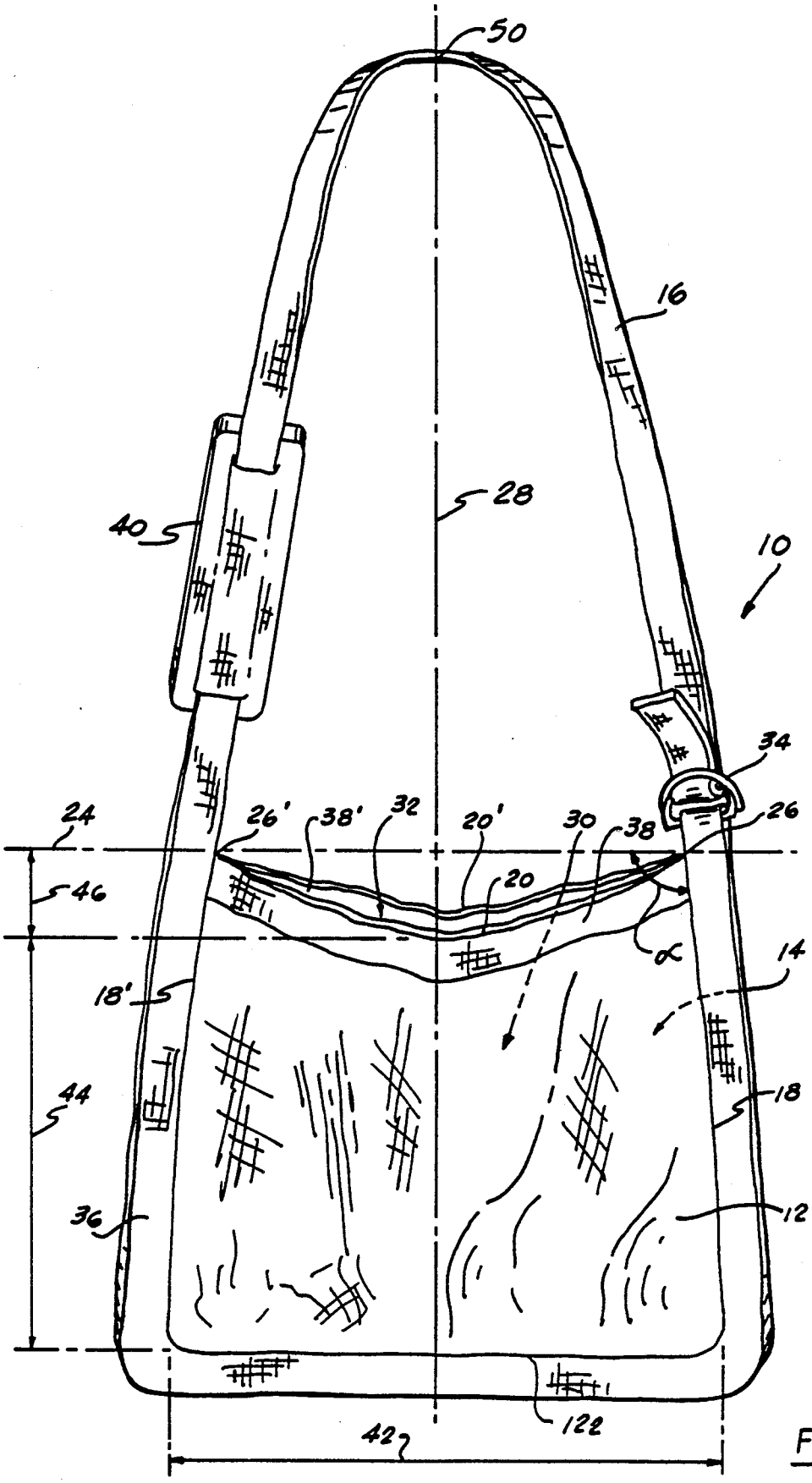
FIG. 2 is a perspective view of a representative alternate embodiment of the self-closing shoulder bag constructed in accordance with the present invention.

Generally speaking, the front panel 12 is a piece of flat, flexible material having two substantially straight side edges 18,18', a concave top edge 20, and a straight bottom edge 122 (as shown in FIG. 2) or convex bottom edge 22 (as shown in FIG. 1). Each side edge 18,18' forms an interior angle $\alpha°$ with a reference line 24 connecting the apexes 26,26' of the side edges 18,18'. The top edge 20 and the bottom edge 22 are each symmetrical about a vertical axis 28 perpendicular to the midpoint of the reference line 24 between the apexes 26,26'. The top edge 20 curves concavely upward on either side of the vertical axis 28. The straight bottom edge 122 is generally parallel to reference line 24, as shown in FIG. 2. The convex bottom edge is convexly curved upward from its midpoint at the vertical axis 28 as shown in FIG. 1.

The back panel 14 is substantially identical to the front panel 12 in size, shape, and construction. The back panel 14 and the front panel 12 are attached contiguously along their side edges 18,18' and bottom edges 22. A pouch 30 is thereby formed between the front panel 12 and the back panel 14, with an opening 32 defined by the top edges 20,20' of the two panels 12,14.

The shoulder strap 16 is made of flexible material, e.g., by folding and stitching a narrow strip of fabric lengthwise. One end of the strap 16 is attached to one apex 26, and the other end of strap 16 is attached to the other apex 26'. This completes the basic construction of the shoulder bag 10.

The shoulder bag 10 may also be provided with a means 34 for adjusting the length of the strap 16. For example, the strap 16 can be cut near one apex 26' and two D-rings 34 attached to the short segment of the strap 16 near the apex 26. The long segment of the strap 16 is passed as shown through the D-rings 34, and in this manner the overall length of the strap 16 can be reversibly adjusted while the bag 10 is in use. Alternatively, a conventional buckle or hook-and-eye adjustment means 34 can be provided in the strap 16.

The shoulder bag 10 may also be provided with a side border 36 of flat flexible material attached contiguously along the common side edges 18,18' and bottom edge 22 or 122 of the panels 12,14.

The opening 32 of shoulder bag 10 may also be provided with top borders 38,38' attached to the top edges 20,20' of the panels 12, 14. Each top border 38 or 38' is made of flat flexible material which may be folded lengthwise and attached along the top edge 20 or 20'.

A shoulder pad 40 of thicker and wider material may also be slidably disposed along the strap 16.

In the representative embodiment of the invention, all components of the bag 10, except the optional adjustment means 34 and shoulder pad 40, are made of Argonant TM 100% acrylic marine duck fabric, with the front and back panels each consisting of a double thickness of this fabric. However, any flexible fabric or material may be used in place of the above-described fabric.

Considered now in particular detail, the subject bag 10 is dimensionally configured so that the opening 32 will stay closed when the bag 10 is hung from the shoulder. As used herein, the term "width" (as indicated by reference numeral 42) means the maximum dimension of the front panel 12 perpendicular to the vertical axis 28. The term "height" (as indicated by reference numeral 44) means the distance between the top edge 20 and the bottom edge 22 or 122 of the front panel 12 along the vertical axis 28. By "depth" (as indicated by reference numeral 46) is meant the distance along the vertical axis 28 between reference line 24 and the top edge 20 of the front panel 12. The term "radius of curvature" (as indicated by reference numeral 48) means the radius of the largest circle tangent to the bottom edge 22 of the front panel 12, and passing through the two points 49,49' of the front panel 12 furthest apart perpendicular to the vertical axis 28.

In a representative embodiment, the subject bag 10 has the following dimensions: a width 42 of approximately 13.8 inches, a height 44 of approximately 12.5 inches, and a depth 46 (as defined in the paragraph above) of approximately 3 inches. The bottom edge 22 has a radius of curvature 48 of approximately 9.0 inches, and the interior angle $\alpha°$ is approximately 96 degrees. The strap 16 is approximately 1 inch wide and at least 50 inches long. The side border 36 and top borders 38,38', if present, may each be approximately 1 inch wide.

When the representative bag 10 is hung by the midpoint 50 of its strap 16, and the top edges 20,20' are momentarily applied together, the opening 32 will not gap open, even when a substantial weight is carried in the pouch 30. This "self-closing" feature advantageously protects the contents of the pouch 30 from rain, dust, etc., and keeps them out of sight, without the mandatory provision of a mechanical closure that can be cumbersome and/or noisy to operate. As a result, this self-closing bag 10 is convenient for carrying diapers and other children's supplies on outings such as day trips. The immediate and silent access to the pouch 30 afforded by the self-closing configuration and construction makes this a superb bag 10 for hunters and wildlife observers. In fact, this bag 10 is advantageous for any practical situation in which items must be introduced or removed from the pouch 30 while the bag 10 is slung over the shoulder. The bag 10 is easily opened and closed with one hand, because no mechanical closure like a zipper or buckle is required, and the particular configuration ensures that the opening 32 will nevertheless stay closed while the bag 10 is in use.

It should be understood that the above-stated dimensions of the representative bag 10 can be varied, within certain constraints, while preserving the self-closing feature. For example, the size of the bag 10 can be increased or decreased proportionally in all linear dimensions by at least up to about 15%, and preferably by no more than about 7%, without adversely affecting the self-closing feature. Likewise, the angle $\alpha°$ can be varied between slightly over 90 degrees and approximately 101 degrees. The relative proportions of various dimensions of the bag 10 may also be selectively modified as described below while maintaining the self-closing feature.

EXAMPLES

In order to evaluate the permissible proportions and dimensions of the self-closing bag 10, seven additional bags were constructed. The shape of the front panel 12 (and back panel 14) of the representative bag 10 was modified as described below to determine the effect on the self-closing feature, in terms of contents that could be suspended in the bag before the opening 32 started to come apart and gap.

Example 1 was the representative self-closing bag 10 described above, having a width 42 of 13.8 inch, a height 44 of 12.5 inches, and a depth 46 of 3.0 inches.

Example 2 was like the bag of Example 1, but with a 1-inch larger depth 46, resulting in a width 42 of 13.8 inches, a height 44 of 11.5 inches, and a depth 46 of 4.0 inches.

Example 3 was like the bag of Example 1, but with a straight bottom edge 122 resulting in a width 42 of 13.5 inches, a height 44 of 12.5 inches, and a depth 46 of 3.0 inches.

Example 4 was like the bag of Example 1, but the size of the panels 12, 14 was increased by extending all edges 18,18',20,22 of the panels 12,14 outward 1 inch, resulting in a width 42 of 15.9 inches, a height 44 of 14.5 inches, and a depth 46 of 3.4 inches.

Example 5 was like the bag of Example 1, but the size of the panels 12,14 was decreased by contracting all edges 18, 18', 20,22 of the panels inward 1 inch, resulting in a width 42 of 12.0 inches, a height 44 of 10.5 inches, and a depth 46 of 2.6 inches.

Example 6 was like the bag of Example 1, but with the common bottom edge 22 extended downward along its entire length 1 inch parallel to the vertical axis 28, resulting in a width 42 of 14.0 inches, a height 44 of 13.5 inches, and a depth 46 of 3.0 inches.

Example 7 was like the bag of Example 1, but with the radius of curvature 48 of the bottom edge 22 increased from approximately 9.0 inches (0.65 times the width 42) to approximately 11.7 inches (0.84 times the width 42) without changing the side edges 18,18', resulting in a width 42 of 13.8 inches, a height 44 of 11.5 inches, and a depth 46 of 3.0 inches.

Example 8 was like the self-closing bag of Example 1, but with straight top edges 120,120' lying on the reference line 24, resulting in a width 42 of 13.8 inches, a height 44 of 15.5 inches, and a depth 46 of 0.0 inches.

Each of these example bags was suspended by a hook at the midpoint 50 of its 50-inch strap 16. Various combinations of weights were placed into the pouch 30; the top edges 20,20' (or 120,120') were then momentarily closed by finger pressure; and an observation was made as to whether the top edges 20,20' (or 120,120') pulled apart and the opening 32 gapped when the finger pressure was released. The following combination of weights was used: a three-pound barbell approximately seven inches long; two such three-pound barbells; a five-pound disk weight approximately seven inches in diameter; two such five-pound disk weights; and two such three-pound barbells and two such five-pound disk weights.

The dimensions of the example bags and the results of the above-described tests are summarized in the following table, wherein "+" indicates that the opening 32 remained closed, and "−" indicates that the opening 32 did not remain closed.

| | Ex 1 | Ex 2 | Ex 3 | Ex 4 | Ex 5 | Ex 6 | Ex 7 | Ex 8 |
|---|---|---|---|---|---|---|---|---|
| width | 13.8 | 1.8 | 13.5 | 15.9 | 12.0 | 14.0 | 13.8 | 13.8 |
| height | 12.5 | 11.5 | 12.5 | 14.5 | 10.5 | 13.5 | 11.5 | 15.5 |
| depth | 3.0 | 4.0 | 3.0 | 3.4 | 2.6 | 3.0 | 3.0 | 0.0 |
| depth/width ratio | .217 | .289 | .222 | .216 | .213 | .214 | .217 | 0.0 |
| 3 lbs | + | + | + | + | + | + | + | + |
| 2 × 3 lbs | + | + | + | + | + | + | + | + |
| 5 lbs | + | − | + | + | − | + | + | + |

-continued

| | Ex 1 | Ex 2 | Ex 3 | Ex 4 | Ex 5 | Ex 6 | Ex 7 | Ex 8 |
|---|---|---|---|---|---|---|---|---|
| 2 × 5 lbs | + | − | − | + | − | − | − | − |
| 2 × (3 + 5) lbs | + | − | − | + | − | − | − | − |

Referring to the experimental results as set forth in the table, for bags with curved top edges 20,20', the self-closing feature was crucially related to the ratio of the depth 46 to the width 42 ("depth/width ratio"). Various other dimensional factors, such as width 42, height 44, depth 46, radius of curvature 48, ratio of depth 46 to height 44, and ratio of height 44 to width 42, were also compared, but none of these alone correlated well with the weight(s) the example bags supported before the top edges 20,20' pulled apart when the finger pressure was released.

For bags with curved top edges 20,20', a comparison of the depth/width ratio and the weight the bag will support before the top edges 20,20' pull apart demonstrates (a) an operative depth/width ratio, (b) a preferred depth/width ratio, and (c) a most preferred depth/width ratio. As shown by the bags of Examples 1 through 7, the operative range of the invention 10 has a depth/width ratio of between 0.213 and 0.289. Specifically, the top edges 20,20' pulled apart with the five-pound weight in the pouch 30 when the ratio of the depth/width ratio was equal to 0.213 (Example 5) or 0.289 (Example 2), but did not pull apart where the depth/width ratio was between these two values. The preferred range of the depth/width ratio is exemplified by the bags 10 of Examples 1, 3, 4, 6, and 7, where the top edges 20,20' stayed closed with the five-pound weight in the pouch 30 when the depth/width ratio was equal to or between 0.214 and 0.222. In the most preferred embodiment, exemplified by the bags 10 of Examples 1 and 4 where the top edges 20,20' stayed closed with all four weights (i.e., 16 pounds) in the pouch 30, the depth/width ratio is approximately 0.217. Moreover, a comparison of the bags 10 of Examples 1 and 7 demonstrates that increasing the radius of curvature 48 of the common bottom edge 22 from approximately 0.65 times the width 42 (Example 1) to approximately 0.84 times the width 42 (Example 7) reduces the weight the bag 10 will support while retaining the self-closing feature. Therefore, the most preferred embodiment has both a depth/width ratio of approximately 0.217 and a radius of curvature 48 less than approximately 0.84 times the width 42.

Figure 3:
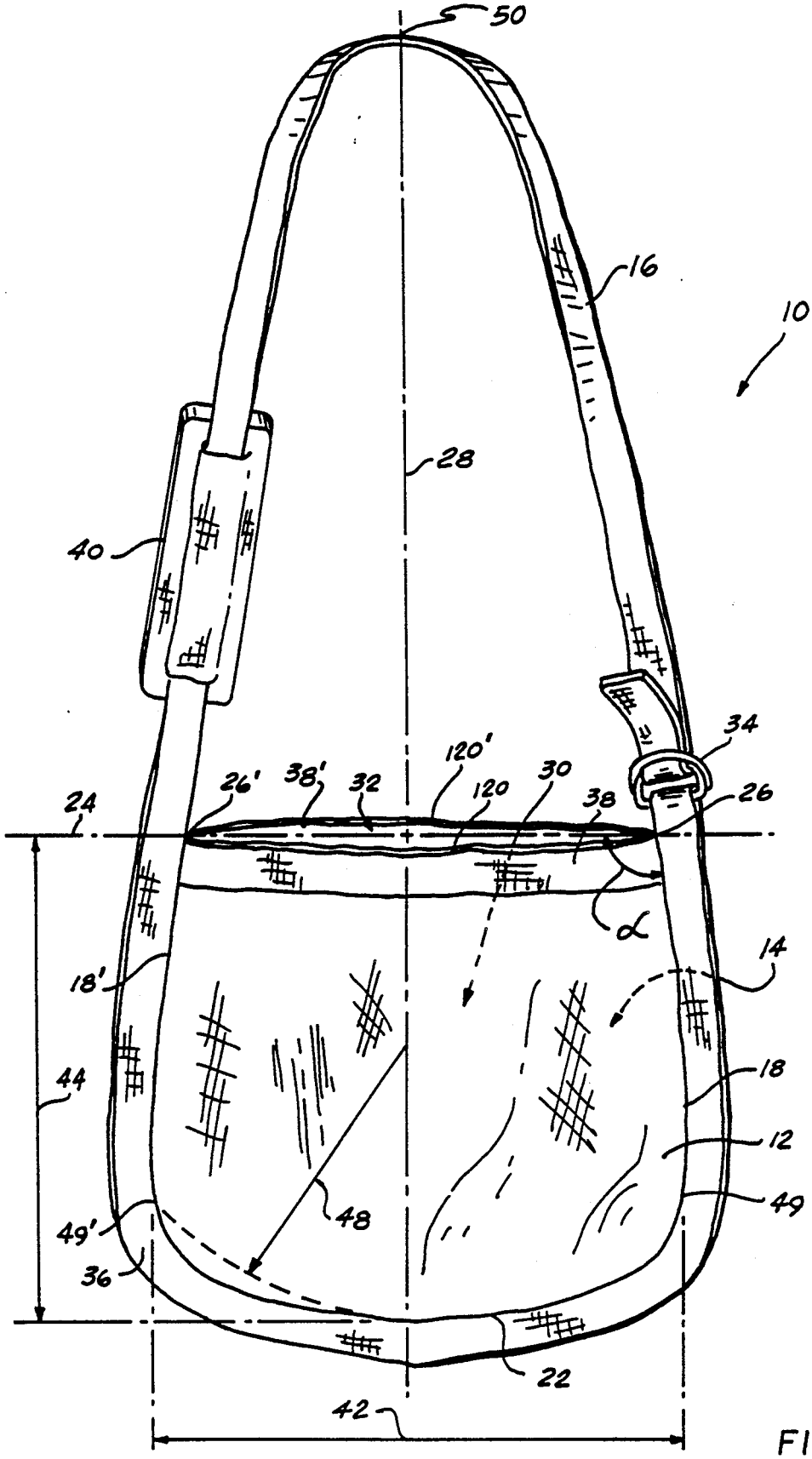
FIG. 3 is a perspective view of a representative second alternate embodiment of the self-closing shoulder bag constructed in accordance with the present invention.

Example 8 represents an alternative embodiment wherein the top edges 120,120' are straight and the bottom edge 22 is curved. In this configuration, shown in FIG. 3, the top edges 120,120' remained closed with the five-pound weight in the pouch 30.

While the present invention has been described in conjunction with a preferred embodiment and illustrative examples, one of ordinary skill after reading the foregoing specification will be able to effect various changes, substitutions of equivalents, and other alterations to the articles set forth herein. It is therefore intended that the protection granted by Letters Patent hereon be limited only by the definition contained in the appended claims and equivalents thereof.

The embodiments of the invention in which an exclusive property or privilege is claimed are defined as follows:

1. A self-closing bag comprising:

a front panel of flat flexible material having two side edges, each side edge forming an obtuse interior angle of between about 90 degrees and about 101 degrees with a reference line connecting the top of one side edge and the top of the other side edge, a concavely curved top edge symmetrical about a vertical axis perpendicular to and passing through the midpoint of the reference line, and a convexly curved bottom edge symmetrical about the vertical axis, wherein the maximum width of the panel perpendicular to the vertical axis is between about 11.8 inches and about 15.8 inches, wherein the distance along the vertical axis between the top edge and the bottom edge is between about 0.83 and about 0.96 times said maximum width, and wherein the distance along the vertical axis between the reference line and the top edge of said panel is between about 0.213 and about 0.289 times said maximum width;

a back panel of flat flexible material substantially identical in size and shape to the front panel and attached contiguously to the front panel along corresponding portions of the side and bottom edges of the two panels to form a pouch between the front panel and the back panel with an opening formed by the top edges of the front and back panels; and a strap of flat flexible material, with one end of the strap attached near the upper end of one common side edge of the front and back panels, and the other end of the strap attached near the upper end of the other common side edge of the front and back panels.

2. The self-closing bag of claim 1, wherein the distance along the vertical axis between the reference line and the top edge of the front panel is between about 0.214 and about 0.222 times said maximum width.

3. The self-closing bag of claim 1, wherein the distance along the vertical axis between the reference line and the top edge of the front panel is equal to about 0.217 times said maximum width.

4. The self-closing bag of claim 3, wherein the distance along the vertical axis between the top edge and the bottom edge of the front panel is about 0.90 times said maximum width.

5. The self-closing bag of claim 3, wherein the bottom edge has a radius of curvature less than 0.84 times said maximum width.

6. The self-closing bag of claim 1, further comprising:

a side border of flat flexible material attached to the common bottom and side edges of the front and back panels.

7. The self-closing bag of claim 1, further comprising:

top borders of flat flexible material attached to the top edge of at least one of the front and back panels.

8. The self-closing bag of claim 1, further comprising:

a means for adjusting the length of the strap.

9. A self-closing bag comprising:

a front panel of flat flexible material having two side edges, each side edge forming an obtuse interior angle of between about 90 degrees and about 101 degrees with a reference line connecting the top of one side edge and the top of the other side edge, a straight top edge lying on the reference line, and a convexly curved bottom edge symmetrical about a vertical axis perpendicular to and passing through the midpoint of the reference line, wherein the maximum width of said panel perpendicular to the vertical axis is between about 11.8 inches and about 15.8 inches, wherein the distance along the vertical axis between the top edge and the bottom edge is about 1.12 times said maximum width, and wherein the radius of curvature of the bottom edge is about 0.65 times said maximum width;

a back panel of flat flexible material substantially identical in size and shape to the front panel and attached to the front panel along corresponding portions of the side and bottom edges of the two panels to form a pouch between the front panel and the back panel with an opening formed by the top edges of the front and back panels; and a strap of flat flexible material, with one end of the strap attached near the upper end of one common side edge of the front and back panels and the other end of the strap attached near the upper end of the other common side edge of the front and back panels.

10. A self-closing bag comprising:

a front panel of flat flexible material having two side edges, each side edge forming an obtuse interior angle of between about 90 degrees and about 101 degrees with a reference line connecting the top of one side edge and the top of the other side edge, a concavely curved top edge symmetrical about a vertical axis perpendicular to and passing through the midpoint of the reference line, and a straight bottom edge symmetrical about the vertical axis, wherein the maximum width of the panel perpendicular to the vertical axis is between about 11.8 inches and about 15.8 inches, wherein the distance along the vertical axis between the top edge and the bottom edge is between about 0.83 and about 0.96 times said maximum width, and wherein the distance along the vertical axis between the reference line and the top edge of said panel is between about 0.213 and about 0.289 times said maximum width;

a back panel of flat flexible material substantially identical in size and shape to the front panel and attached contiguously to the front panel along corresponding portions of the side and bottom edges of the two panels to form a pouch between the front panel and the back panel with an opening formed by the top edges of the front and back panels; and a strap of flat flexible material, with one end of the strap attached near the upper end of one common side edge of the front and back panels, and the other end of the strap attached near the upper end of the other common side edge of the front and back panels.

11. The self-closing bag of claim 10, wherein the distance along the vertical axis between the reference line and the top edge of the front panel is between about 0.214 and about 0.222 times said maximum width.

12. The self-closing bag of claim 10, wherein the distance along the vertical axis between the reference line and the top edge of the front panel is equal to about 0.217 times said maximum width.

13. The self-closing bag of claim 12, wherein the distance along the vertical axis between the top edge and the bottom edge of the front panel is about 0.90 times said maximum width.

14. The self-closing bag of claim 10, further comprising:

a side border of flat flexible material attached to the common bottom and side edges of the front and back panels.

15. The self-closing bag of claim 10, further comprising:

top borders of flat flexible material attached to the top edge of at least one of the front and back panels.

16. The self-closing bag of claim 10, further comprising:

a means for adjusting the length of the strap.

* * * * *

UNITED STATES PATENT AND TRADEMARK OFFICE

CERTIFICATE OF CORRECTION

PATENT NO. : 4,989,656

DATED : February 5, 1991

INVENTOR(S) : P.A. Derfler

It is certified that error appears in the above-identified patent and that said Letters Patent is hereby corrected as shown below:

| Column | Line | |
|---|---|---|
| 2 | 27 | "edges 22." should be --edges 22 or 122.-- |
| 2 | 41 | "apex 26" should be --apex 26'-- |
| 2 | 53 | "12, 14" should be --12,14-- |
| 4 | 15 | "12, 14" should be --12,14-- |
| 4 | 21 | "18, 18', 20,22" should be --18,18',20,22-- |
| 4 | 62 | "1.8" should be --13.8-- |

Signed and Sealed this

Eighth Day of December, 1992

*Attest:*

DOUGLAS B. COMER

*Attesting Officer*

*Acting Commissioner of Patents and Trademarks*